US006202537B1

(12) United States Patent
Havran

(10) Patent No.: US 6,202,537 B1
(45) Date of Patent: Mar. 20, 2001

(54) CONNECTING ROD FOR HORIZONTALLY OPPOSED COMPRESSOR

(75) Inventor: Richard L. Havran, Lafayette, IN (US)

(73) Assignee: Caterpillar Inc., Peoria, IL (US)

( * ) Notice: Subject to any disclaimer, the term of this patent is extended or adjusted under 35 U.S.C. 154(b) by 0 days.

(21) Appl. No.: 09/351,665

(22) Filed: Jul. 13, 1999

(51) Int. Cl.[7] ..... F01B 1/00
(52) U.S. Cl. ..... 92/72; 92/140
(58) Field of Search ..... 91/68, 72, 73, 91/76, 84, 140

(56) References Cited

U.S. PATENT DOCUMENTS

| | | | | |
|---|---|---|---|---|
| 405,150 | * | 6/1889 | Dodd | 92/72 X |
| 2,052,472 | * | 8/1936 | Hyman | 92/72 X |
| 3,000,367 | | 9/1961 | Eagleson . | |
| 3,112,658 | | 12/1963 | Derlyn . | |
| 3,175,544 | * | 3/1965 | Hughes | 92/72 X |
| 3,457,804 | | 7/1969 | Harkness . | |
| 3,474,768 | | 10/1969 | Anesetti . | |
| 4,000,666 | | 1/1977 | Ito et al. . | |
| 4,408,380 | | 10/1983 | Schaper et al. . | |
| 4,481,918 | | 11/1984 | Morton . | |
| 4,530,255 | | 7/1985 | Haslam . | |
| 5,031,512 | | 7/1991 | Graziani . | |
| 5,435,232 | * | 7/1995 | Hammerton | 92/76 X |
| 5,529,466 | | 6/1996 | Tackett . | |

FOREIGN PATENT DOCUMENTS

| | | | | |
|---|---|---|---|---|
| 2947713 A1 | * | 7/1981 | (DE) | 92/72 |

* cited by examiner

*Primary Examiner*—John E. Ryznic
(74) *Attorney, Agent, or Firm*—Fred J. Baehr

(57) ABSTRACT

A horizontally opposed compressor having a crankshaft and an even number of diametrically opposed cylinders, each opposed cylinder having a piston and a single connecting rod cooperatively associated therewith, one of the connecting rods having a crankshaft bearing portion on one end and a wrist pin bearing portion on the other end, the other connecting rod having two spaced apart legs, each leg having a crankshaft bearing portion on one end, the other end of the legs coming together to form a wrist pin bearing portion and a wishbone shaped connecting rod, the spacing between the legs being sufficient to allow the crankshaft portion of the one connecting rod and the associated portion of the crankshaft to rotate between the legs so that the reciprocating mass forces associated with the opposed cylinders are generally equal and opposite and cancel each other to produce a smooth running compressor.

11 Claims, 4 Drawing Sheets

CONNECTING ROD FOR HORIZONTALLY OPPOSED COMPRESSOR

TECHNICAL FIELD

The invention relates to a connecting rod and more particularly to a connecting rod for a horizontally opposed compressor engine with 2 or 4 throw cylinders.

BACKGROUND ART

Horizontally opposed compressors are conventionally designed with the opposed cylinders offset. In 2 and 4 throw cylinder compressors an unbalanced dynamic couple force is inherent due to the offset of the opposed reciprocating mass. In 6 throw cylinder compressors the unbalanced dynamic couple forces can be substantially balanced out with proper phasing of the cylinders. U.S. Pat. No. 3,474,768 describes a diametrically opposed 4 cylinder engine with two concentric shafts that only rotate 180°, the 180° rotation is converted to 360° rotation by a connecting rod transferring the 180° rotation of each of the concentric shafts to a crankshaft.

DISCLOSURE OF THE INVENTION

Among the objects of this invention may be noted the provision of a horizontally opposed engine in which the cylinders are diametrically opposed to eliminate force couples inherent when the opposed cylinders are off set.

In general, a horizontally opposed engine when made in accordance with this invention comprises a crankshaft and at least two diametrically opposed cylinders. Each opposed cylinder has a piston and a single connecting rod cooperatively associated with the piston and the crankshaft. One of the connecting rods has a crankshaft bearing portion on one end and a wrist pin bearing portion on the other end. The other connecting rod has two spaced apart legs with a crankshaft bearing portion disposed on one end of each of the legs, the other end of the legs come together to form a wrist pin bearing portion. The spacing between the legs is sufficient to allow a portion of the crankshaft cooperatively associated with the crankshaft bearing portion of the one connecting rod to rotate between the legs of the other connecting rod. Thus, the reciprocating mass forces associated with the diametrically opposing cylinders are generally equal and opposite and cancel one another producing a smoother running engine.

BRIEF DESCRIPTION OF THE DRAWINGS

The invention as set forth in the claims will become more apparent by reading the following detailed description in conjunction with the accompanying drawings, wherein like reference numerals refer to like parts throughout the drawings and in which:

BEST MODE FOR CARRYING OUT THE INVENTION

Figure 1:
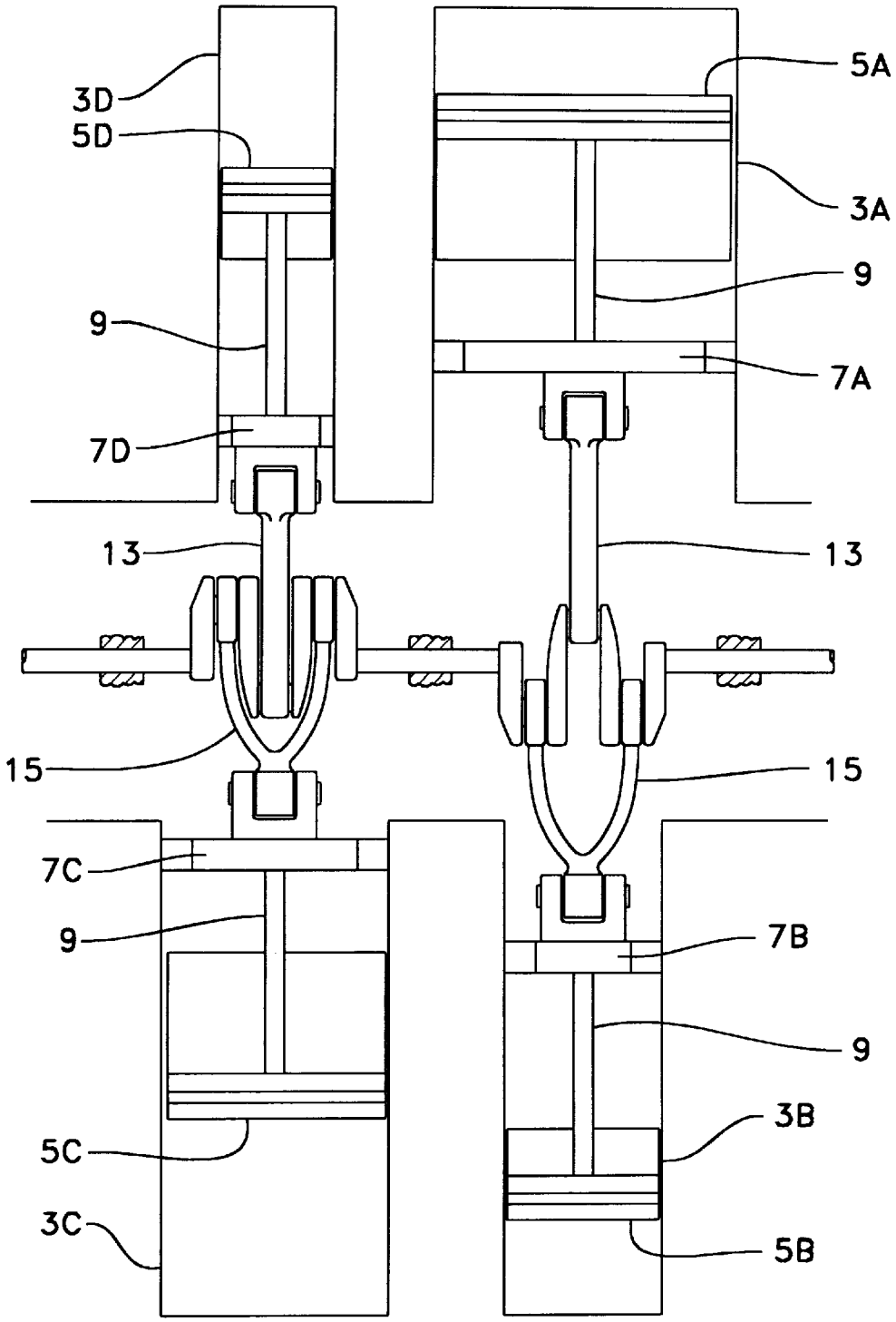
FIG. 1 is a schematic view of a horizontal diametrically opposed four throw air compressor.

Referring now to the drawings in detail and in particular to FIG. 1, there is shown a four throw horizontal diametrically opposed double acting compressor engine 1. While the engine 1 is shown as a four throw double acting compressor it could have any even number of cylinders 3 or be single acting or be an internal combustion engine. The diametrically opposed cylinders 3A, 3B, 3C and 3D are shown to have different diameters to balance the forces due to compressing the gasses in multi stages. There is normally an inter cooler (not shown) between the stages. Illustratively, cylinders 3A and 3B are respectively the first and third stage and cylinders 3C and 3D are respectively the second and fourth stage. Each cylinder 3A, 3B, 3C, and 3D comprises a piston 5A, 5B, 5C and 5D, respectively, a crosshead 7A, 7B, 7C and 7D, respectively, and a piston rod 9 connecting the piston 5A, 5B, 5C and 5D to the respective crosshead 7A, 7B, 7C and 7D.

Figure 2:
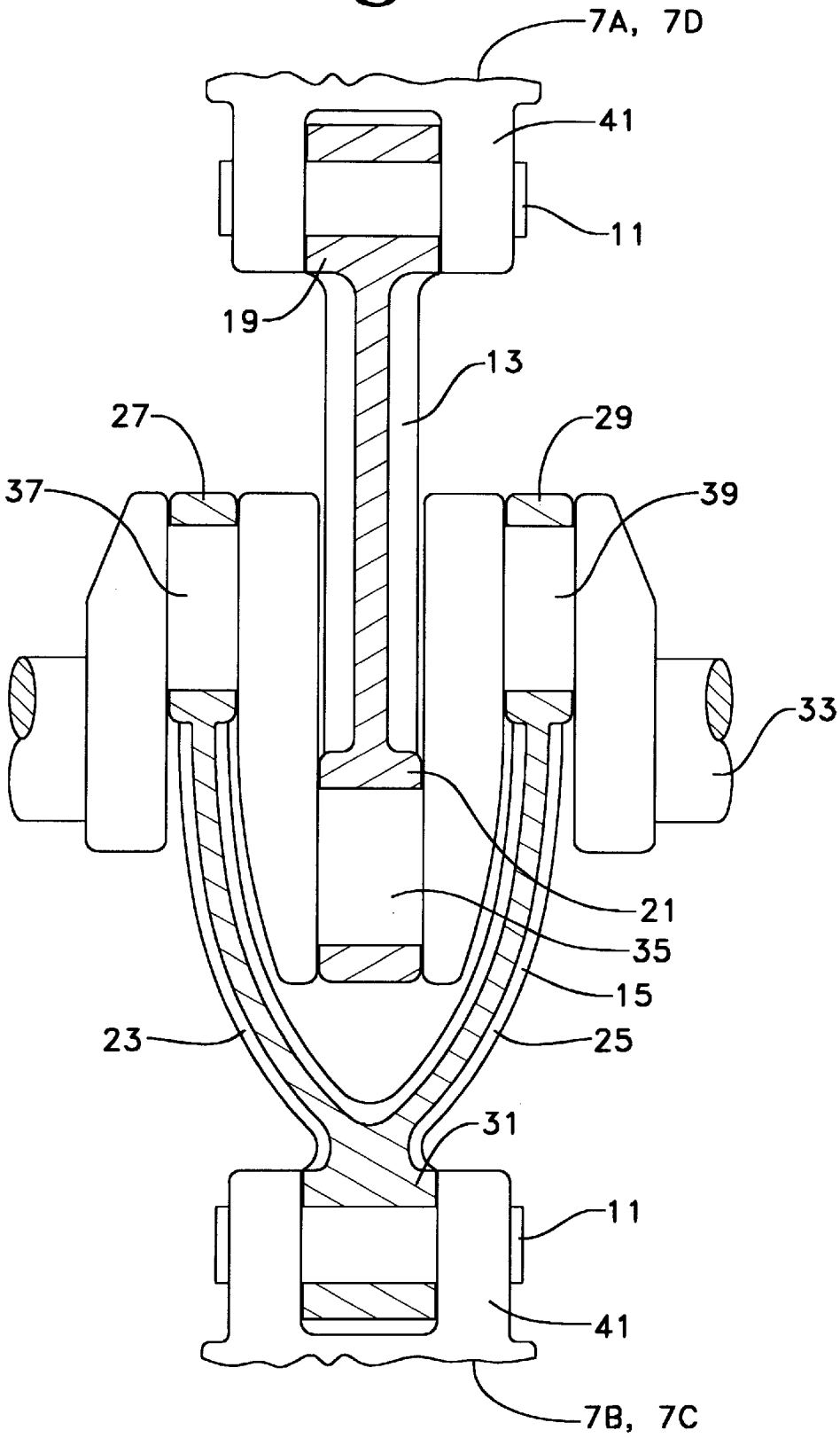
FIG. 2 is a partial sectional view of a crankshaft and connecting rods.

Referring now to FIG. 2 wrist pins 11 connect connecting rods 13 to the crossheads 7A and 7D and connecting rods 15 to crossheads 7B and 7C. The connecting rods 13 are conventional with a wrist pin bearing portion 19 on end and a crankshaft bearing portion 21 on the other end. The connecting rods 15 are generally Y or wish bone shaped having two spaced apart legs 23 and 25 with a crankshaft bearing portion 27 and 29 respectively on one end of each of the leg 23 and 25. The other end of the legs 23 and 25 come together to form a wrist pin bearing portion 31. A crankshaft 33 has a bearing surface 35 to receive the crankshaft bearing portion 21 of the connecting rod 13. The crankshaft 33 has two bearing surfaces 37 and 39 disposed outboard of the bearing surface 35 and off set therefrom 180°. The bearing surfaces 37 and 39 on the crankshaft 33 receive the crankshaft bearing portions 27 and 29 respectively. The area of each the bearing surfaces 37 and 39 is generally about ½ the area of the bearing surface 35. The spacing between the legs 23 and 25 is sufficient to allow the crankshaft portion cooperatively associated with the bearing surface 35 and the crankshaft bearing portion 21 of the connecting rod 13 to rotate between the legs 23 and 25 of the connecting rod 15. This arrangement allows the opposed cylinders 3A and 3B or 3C and 3D to be diametrically opposed on the same center line thus the dynamic mass forces can be made equal and opposite canceling each other and not producing force couples, thus making a smoother running engine. The wrist pin bearing portions 19 and 31 receive the wrist pin 11 to connect the connecting rods 13 and 15 to a clevis 41 disposed on the crossheads 7A, 7B, 7C and 7D.

Figure 3:
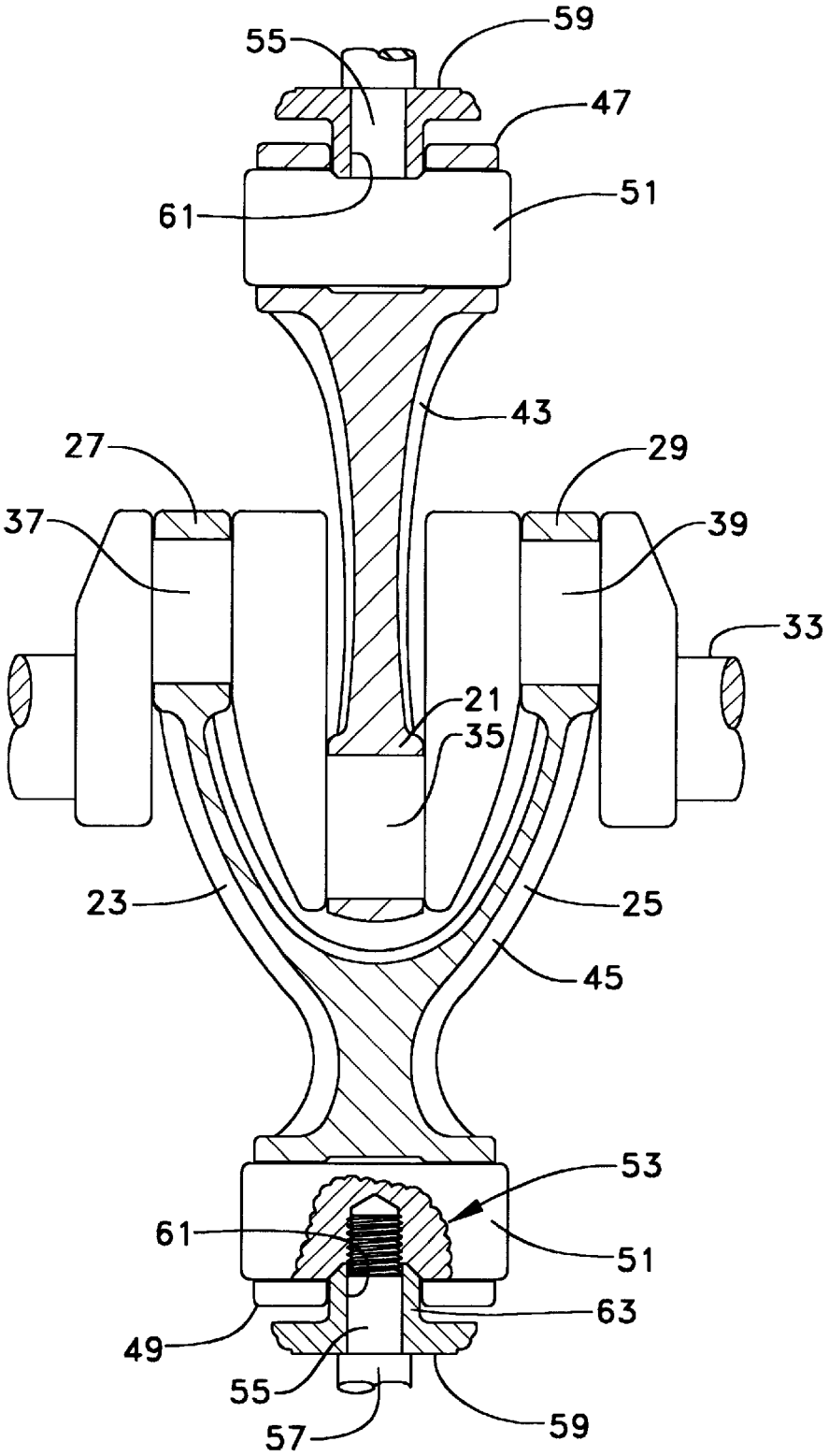
FIG. 3 is a partial sectional view of an alternative crankshaft and connecting rods.

FIG. 3 shows and alternative connecting rods 43 and 45 which have different wrist pin bearing portions 47 and 49 respectively other wise the connecting rods 13 and 15 and 43 and 45 are essentially the same. The wrist pin bearing portions 47 and 49 are made in the form of a clevis that receives a wrist pin 51 and allows it to oscillate. The wrist pin 51 is drilled and tapped as indicated at 53 to receive a turned down, threaded end 55 of a piston rod 57. The crosshead 59 has a central bore 61 and a boss 63, which cooperates with the wrist pin 51 to connect the connecting rods 43 and 45 to the crosshead 59 and the piston rod 57. This arrangement reduces the weight of the wrist pin, crosshead and piston rod junction.

Figure 4:
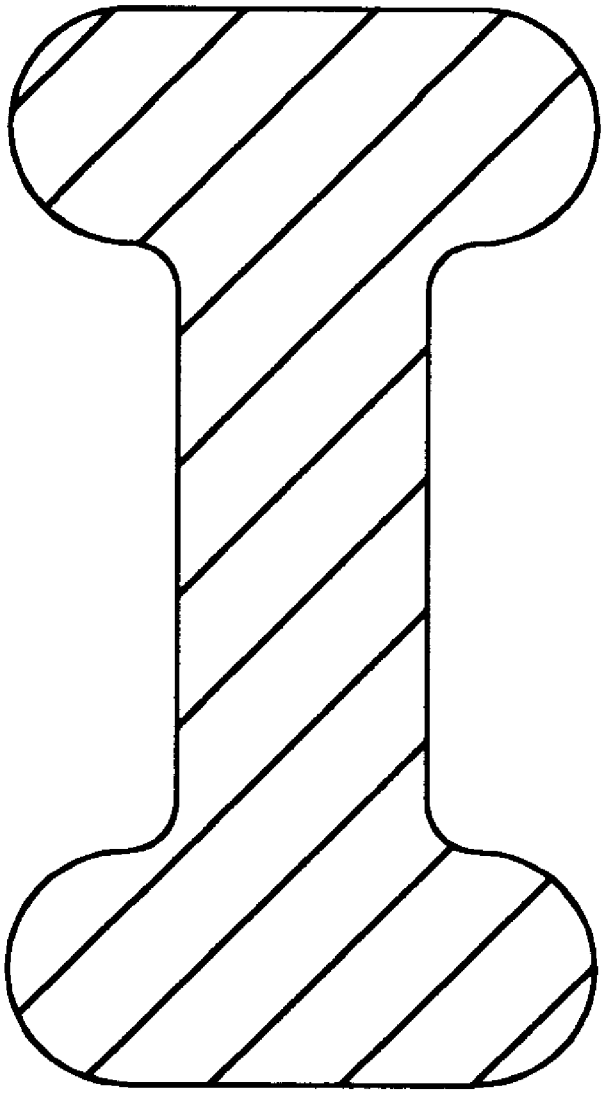
FIG. 4 is a typical cross section of the connecting rods intermediate of the ends.

FIG. 4 shows a typical I-beam cross section not to scale of the connecting rods 13, 15, 43 and 45 at some location inboard of the ends thereof.

While the preferred embodiments described herein set forth the best mode to practice this invention presently contemplated by the inventor, numerous modifications and adaptations of this invention will be apparent to others of ordinary skill in the art. Therefore, the embodiments are to be considered as illustrative and exemplary and it is understood that the claims are intended to cover such modifications and adaptations as they are considered to be within the spirit and scope of this invention.

INDUSTRIAL APPLICABILITY

A horizontal diametrically opposed engine when made in accordance with this invention advantageously provides that the horizontally opposed cylinders be diametrically opposed on the same center line. This allows the engine designer to make the dynamic forces equal and opposite canceling each other so force couples are not created to produce a smooth running engine. Off set horizontally opposed cylinders produce dynamic force couples that must be compensated for.

What is claimed is:

1. A horizontally opposed engine comprising crankshaft and at least two diametrically opposed cylinders, each opposed cylinder having a piston and a single connecting rod cooperatively associated with the piston and the crankshaft, one of the connecting rods having a crankshaft bearing portion on one end and a wrist pin bearing portion on the other end, the other connecting rod having two spaced apart legs with a crankshaft bearing portion disposed on one end of each of the legs, the other end of the legs coming together to form a wrist pin bearing portion, the spacing between the legs being sufficient to allow a portion of the crankshaft cooperatively associated with the crankshaft bearing portion of the one connecting rod to rotate between the legs of the other connecting rod, whereby the reciprocating mass forces associated with the diametrically opposing cylinders are generally equal and opposite and cancel one another producing a smoother running engine.

2. A horizontally opposed engine as set forth in claim 1, wherein the other connecting rod is generally wishbone shaped.

3. The horizontally opposed engine as set forth in claim 1, wherein the bearing surface area of each of the two crankshaft bearing portions on the other connecting rod is at least as large as one half of the bearing area of the crankshaft bearing portion on the one connecting rod.

4. The horizontally opposed engine as set forth in claim 3, wherein each cylinder further comprises a cross head, a wrist pin and a piston rod cooperatively associated with the wrist pin bearing portion of the connecting rod to reciprocate the piston in the cylinder.

5. The horizontally opposed engine as set forth in claim 4, wherein wrist pin is bored and threaded to receive the piston rod and the wrist pin bearing portions are in the form of a clevis to allow the wrist pin to oscillate.

6. The horizontally opposed engine as set forth in claim 4, wherein the crosshead has a clevis portion, which receives the wrist pin bearing portion and wrist pin.

7. The horizontally opposed engine as set forth in claim 1, wherein the engine is a compressor having an even number of diametrically opposed cylinders.

8. The horizontally opposed engine as set forth in claim 7, wherein the cross section of the connecting rod inboard of the bearing portions is typically "I" shaped.

9. The horizontally opposed engine as set forth in claim 7, wherein the opposing cylinders are different diameters and the forces are still equal and opposite due to higher operating pressure in the smaller diameter cylinder.

10. The horizontally opposed engine as set forth in claim 1, wherein the cross section of the connecting rod inboard of the bearing portions is typically "I" shaped.

11. The horizontally opposed engine as set forth in claim 4, wherein the cylinders are double acting.

* * * * *